United States Patent [19]

Willus et al.

[11] 4,430,071

[45] Feb. 7, 1984

[54] FEED SEAL FOR BOTTOM FEED CENTRIFUGE

[75] Inventors: Charles A. Willus, Bethel; Kenneth D. Lewis, Wilton; Julian Langer, Stamford, all of Conn.

[73] Assignee: Dorr-Oliver Incorporated, Stamford, Conn.

[21] Appl. No.: 382,732

[22] Filed: May 27, 1982

[51] Int. Cl.[3] ..... B04B 11/00

[52] U.S. Cl. ..... 494/38; 494/65

[58] Field of Search ..... 494/38, 40, 41, 65, 494/66, 70, 30, 2, 22, 23, 27, 29

[56] References Cited

U.S. PATENT DOCUMENTS

| | | | |
|---|---|---|---|
| 3,279,689 | 10/1966 | Honeychurch | 494/38 |
| 3,388,054 | 6/1968 | Keith | 494/22 |
| 3,799,431 | 3/1974 | Lavanchy | 494/35 |
| 4,005,817 | 2/1977 | Charlton | 494/10 |
| 4,067,494 | 1/1978 | Willus | 494/35 |

*Primary Examiner*—Robert W. Jenkins

*Attorney, Agent, or Firm*—Burtsell J. Kearns

[57] ABSTRACT

A nozzle type centrifuge having a bottom feed inlet to a main pumping chamber at the base of the machine for injecting the feed slurry to a rotor bowl having separator discs for effecting a two-fraction separation comprising an overflow at the top and an underflow at the peripheral mid portion of the bowl with a portion of the underflow delivered to a return pumping chamber beneath the main pumping chamber and seal means between said chambers to prevent dilution of the underflow fraction.

10 Claims, 4 Drawing Figures

FEED SEAL FOR BOTTOM FEED CENTRIFUGE

BACKGROUND OF THE INVENTION

The present invention is directed to new and useful improvements in centrifugal machines and in particular to a nozzle type centrifuge having vertically spaced pumping chambers and a bottom feed pipe for introducing a feed slurry upwardly into the centrifuge.

In one nozzle type centrifuge of the type mentioned, a double cone-shaped rotor bowl is provided having a separating chamber comprised of a stack of rotatable separating discs for effecting a two fraction separation of the bottom feed slurry into a heavy nozzle discharge for an underflow fraction at the periphery of the bowl and a light fraction discharge as an overflow at the top of the machine.

Centrifuges of this type are well known and are disclosed in prior art patents such as U.S. Pat. No. 4,005,817 which issued Feb. 1, 1977 and U.S. Pat. No. 4,067,494 which issued Jan. 10 1978. In the centrifuge embodying the present invention such as disclosed in the latter patent a portion of the underflow fraction is returned to the separating discs from an annular return pumping chamber at the base of the rotor bowl. The feed slurry is introduced by injection from the bottom of the centrifuge upwardly into the rotor bowl via a second annular main pumping chamber which is spaced vertically from the return pumping chamber. These pumping chambers propel their respective slurries upwardly to the separating discs in the rotor bowl. The mentioned portion of the underflow which is recycled or returned back to the return pumping chamber enters the return impeller therein and it is pumped to the periphery of the rotor to be discharged again by discharge nozzles. In these centrifuges the rotor arrangement requires that the feed and return impellers be located respectively in spaced vertically adjacent pumping chambers arranged in superimposed relationship. Due to mechanical requirements a passageway is provided between the two chambers adjacent the main feed slurry pipe.

In use problems have been encountered in that a portion of the feed slurry can spill from the main pumping chamber through the passageway to the return pumping chamber. As a result the feed can enter the peripheral underflow discharge zone of the rotor bowl via the return chamber and dilute the underflow product. It is also possible that the diluted return can create buoyancy currents in the peripheral zone of the rotor. These factors can adversely affect the efficiency of the centrifuge in certain applications of use such as starch gluten thickening processes by upsetting the density gradients in the thickening zone of the centrifuge.

It is the object of the present invention to provide a bottom feed centrifuge having novel sealing means between the feed and return pumping chambers.

Another object is to provide a novel sealing means for reducing spillage between the feed and return pumping chambers at the passageway between the two chambers.

Another object is to provide a seal having means for adjusting the position of the seal to vary the gap between the return and feed pumping chambers.

BRIEF SUMMARY OF THE INVENTION

The present invention contemplates a centrifuge wherein the slurry feed pipe is located at the bottom of the machine for delivering the slurry to pumping impellers of the feed pumping chamber for discharge to the separating discs of a double cone-shaped rotor bowl. A novel deflector or seal means is provided on the exterior of the feed pipe and is provided with a sealing lip to seal the passageway between the feed pumping chamber and the return pumping chamber located beneath the feed chamber. Means are adjustably mounted on the feed pipe for adjusting the gap clearance between the pumping chambers.

The above and other objects and advantages of the present invention will appear more fully hereinafter from a consideration of the detailed description which follows taken together with the accompanying drawings wherein one embodiment of the present invention is illustrated.

DETAILED DESCRIPTION

Figure 1:
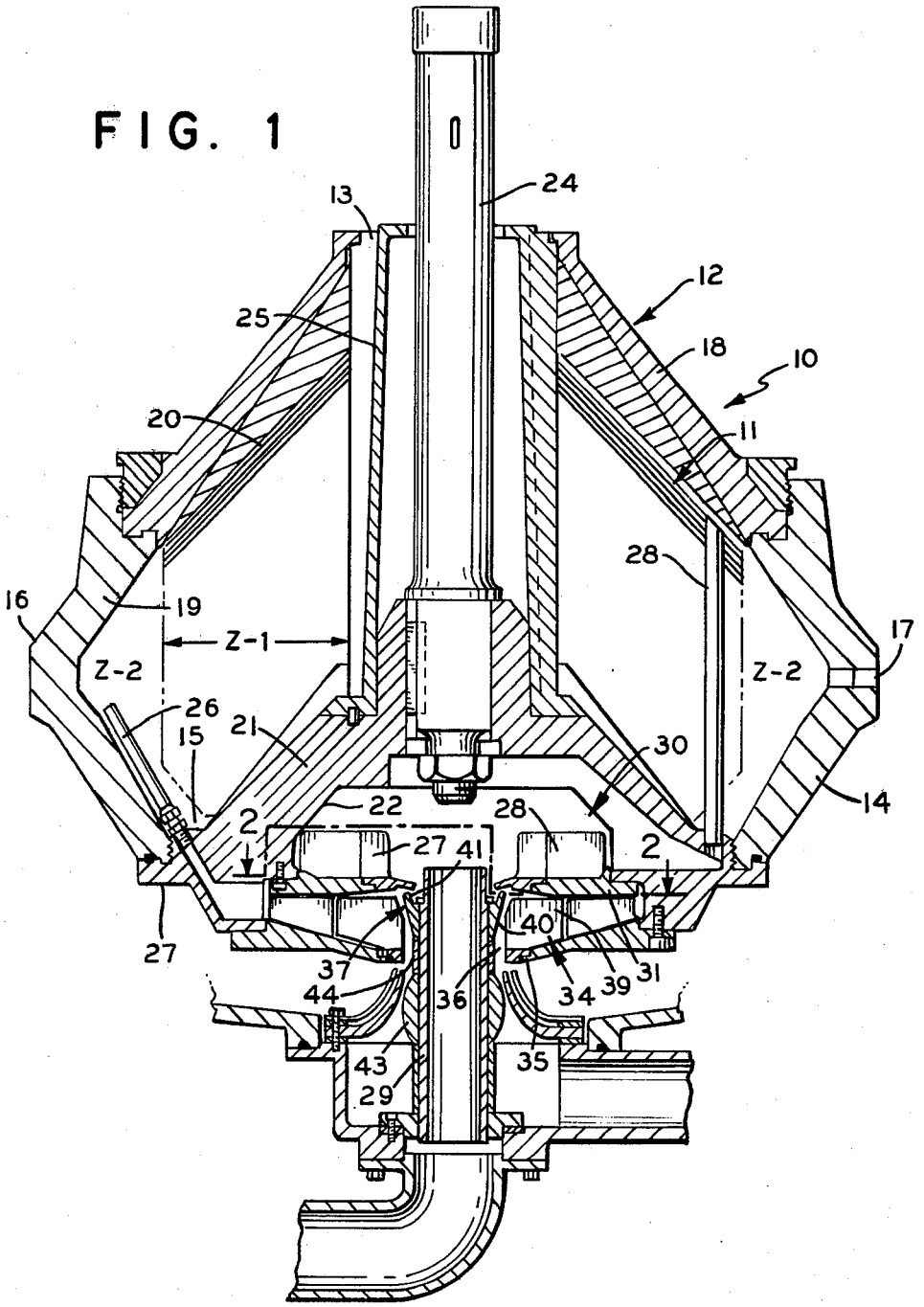
FIG. 1 is a vertical sectional view of a centrifuge embodying the present invention wherein feed and return pumping chambers are arranged relative to a bottom feed pipe.
Figure 2:
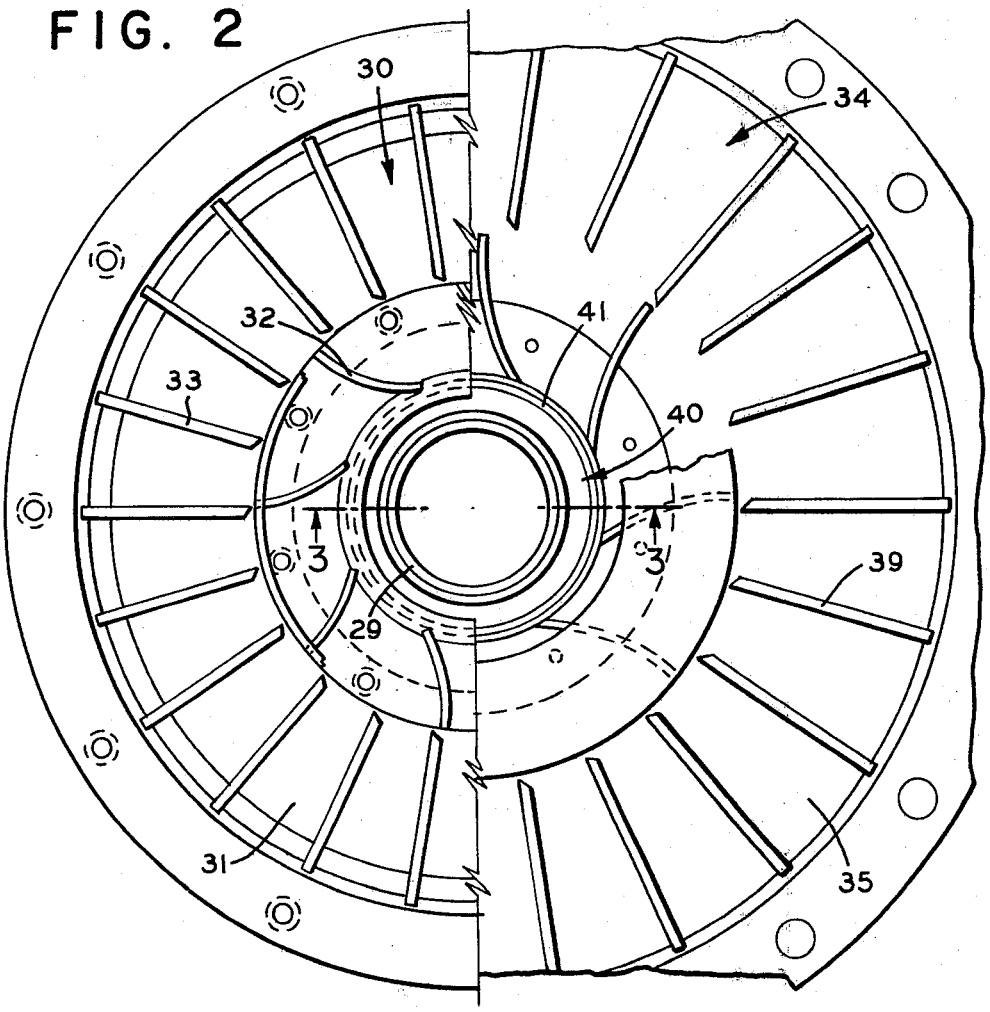
FIG. 2 is a section view taken on the line 2—2 of FIG. 1.
Figure 3:
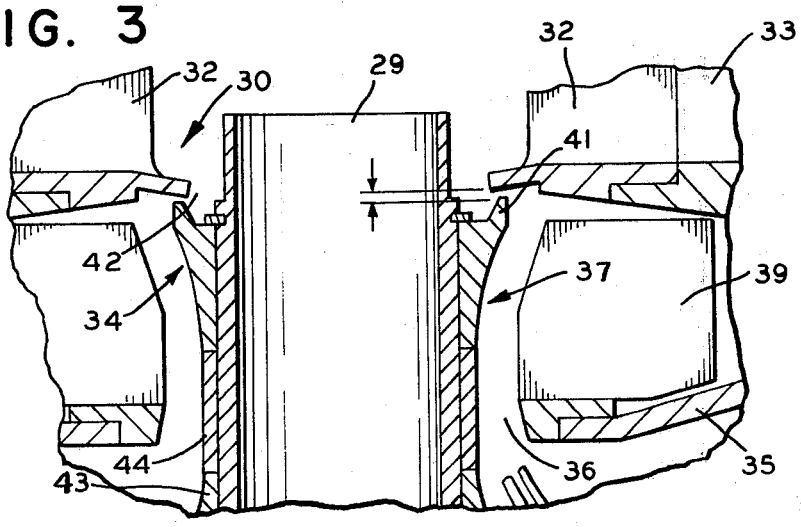
FIG. 3 is a fragmentary enlarged sectional view of the discharge end of the bottom feed pipe taken along line 3—3 of FIG. 2.

Referring now to the drawings and more particularly to FIG. 1 wherein one embodiment of the present invention is clearly illustrated a nozzle type centrifuge is generally indicated by the reference numeral 10. Centrifuge 10 comprises a double cone-shaped rotor bowl 11 having an upright frustro-conical top end section 12 having an overflow opening 13 and an inverted trunco-conical section 14 having a wide bottom opening 15. An intermediate peripheral section 16 of bowl 11 is provided with underflow discharge nozzles 17 (one of which is shown in FIG. 1) for discharging a separated heavy or underflow fraction at the periphery of bowl 11 in a usual manner.

Top end section 12 comprises an upper conical part 18 and a lower complementary section 19 detachably secured together by means of a conventional threaded locking ring (not shown). This two part construction of the rotor bowl provides access in a known manner to a stack of separator discs 20 confined between upper conical part 18 and a hub member 21 which closes wide bottom opening 15 of bowl 11. Hub member 21 is also of a frustro-conical configuration and is formed with a downward facing hollow 22. The stack of separating discs 20 represent an inner annular separating zone Z-1 which is surrounded by a second or outer separating zone Z-2.

A rotatable rotor shaft 24 for rotating bowl 11 is fixed to hub member 21 in a known manner and extends upwardly through the top overflow opening 13. Shaft 24 is surrounded by a customary spider member 25 and is held in place by part of the bowl secured against rotation relative to the hub member.

Outwardly divergent pipes 26 (one of which is shown in FIG. 1) for returning an underflow material from nozzles 17 are equally spaced about rotor and extend from the peripheral portion 27 of hub member 21 into zone Z-2. Also extending upwardly from peripheral portion 27 of hub member 21 is a set of vertical slurry feed pipes 28 (one of which is shown in FIG. 1). Vertical feed pipes 28 and return pipes 26 are more fully disclosed in the U.S. Pat. No. 4,067,494 which is being incorporated by reference herein.

Figure 4:
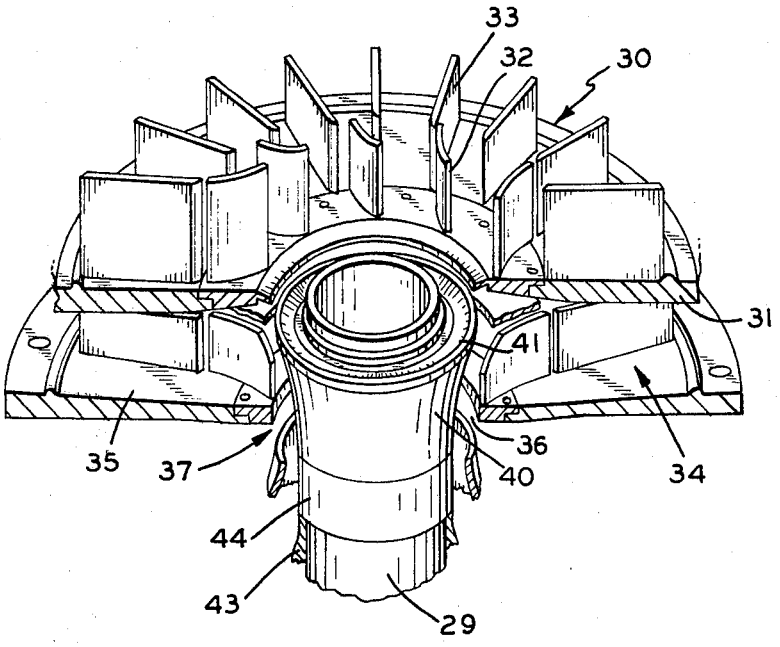
FIG. 4 is a fragmentary perspective view of the discharge end of the feed pipe and sealing means in relation to the spaced pumping chambers.

As seen in FIGS. 1 and 4, a main slurry feed pipe 29 extends upwardly into centrifuge 10 and discharges into an upper pumping chamber 30 formed by hollow 22. Pumping chamber 30 communicates with vertical feed slurry pipes 28. An annular plate 31 carries a set of upright pumping vanes 32–33. A lower pumping chamber 34 is formed between plate 31 and a bottom annular closure plate 35. The closure plate 35 has a central opening 36 and with feed pipe 29 forms an annular passageway 37 between the chambers 30 and 34. Bottom closure plate 35 of lower pumping chamber 34 carries a combination of pumping vanes 39 which register with the discharge nozzles 17.

As mentioned it is a feature of the present invention to prevent spillage of feed slurry material from upper pumping chamber 30 to lower return pumping chamber 34 via annular passageway 37 to avoid dilution of the underflow product. To this end sealing means is provided about the discharge end of central feed pipe 29. Sealing means comprises a circular deflector 40 member slidably fitted over the discharge end of pipe 29. Deflector 40 has a peripheral lip portion 41 in close adjacency with the edges of central opening 42 in plate 31 of upper pumping chamber 30 to prevent spillage of feed from chamber 30 into lower chamber 34. A second sleeve member 43 is provided at the bottom of pipe 29 and is fixed thereto.

Means are provided for varying the gap between opposing edge surfaces of lip 41 and opening 42 in plate 31. These latter means comprise a bushing member 44 intermediate deflector 40 and base sleeve 43. As will be appreciated the vertical dimension of bushing member 44 predetermines the gap and may be of a preselected dimension in accordance with the designs of the centrifuge.

In operation of centrifuge 10 and upon rotation of rotor shaft 24 and rotor bowl 11 the annular plate 31 of pumping chamber 30 is also rotated. It has been found desirable that deflector 40 be preformed from a plastic material such as an ultra high molecular weight polyethylene in order that lip surface 41 may initially engage the surface of plate 31. Upon the said rotation of plate 31 lips 41 will be abraded to set a gap therebetween of approximately 0.10″ to prevent spillage between chambers 30 and 34.

As will be appreciated from the foregoing description the novel sealing means described has many advantages in use. In addition to substantially eliminating spillage between the pumping chambers, means are provided to selectively adjust the gap between the chambers which does not interfere with the operation of the centrifuge and comprises a minimum number of parts.

Although one embodiment of the present invention has been disclosed in detail, it is to be expressly understood that the invention is not limited thereto. Various changes can be made in the design and arrangement of parts without departing from the spirit and scope thereof as the same will now be understood by those skilled in the art.

I claim:

1. A nozzle type centrifuge adapted for a two-phase separation of a feed slurry into a nozzle discharge underflow slurry and an overflow of separated liquid, comprising (a) a rotor having a rotor bowl of double conical configuration with an upper conical portion having a top opening for discharging said overflow, a wide bottom opening and a peripheral intermediate portion having discharge nozzles for said underflow, (b) a first pumping chamber at said wide bottom of said rotor bowl and having a set of pumping vanes for delivering a feed slurry to vertical feed pipes to rotatable separating discs in said rotor bowl, (c) a bottom central slurry feed pipe at the base of said centrifuge having a discharge end in said first pumping chamber, (d) a second pumping chamber vertically spaced beneath said first pumping chamber and having pumping vanes for impelling underflow slurry returned from said peripheral portion of said rotor bowl to said discs, (e) a central passageway concentric with said rotor between said chambers, and (f) sealing means provided in said passageway between said chambers to prevent the feed slurry from said feed chamber from entering said lower return pumping chamber.

2. The centrifuge of claim 1 wherein said sealing means comprises a deflector member on the discharge end of said central feed pipe having a peripheral lip portion spaced from the bottom wall of said first pumping chamber.

3. The centrifuge of claim 2 wherein said deflector comprises a sleeve member slidably fitted over said discharge end of said feed pipe.

4. The centrifuge of claim 3 wherein said deflector is made of a durable plastic material.

5. The centrifuge of claim 4 wherein said plastic is an ultra high molecular weight polyethylene.

6. The centrifuge machine of claim 3 wherein said adjusting means comprise a bushing member of preselected vertical dimension mounted on said feed pipe interposed between said sealing means and a fixed surface.

7. The centrifuge of claim 6 wherein said fixed surface comprises a second sleeve fixed to said feed pipe and spaced from said deflector.

8. The centrifuge machine of claim 2 wherein means are provided for adjusting the vertical position of said deflector on said feed pipe for varying the gap between said peripheral lip portion and the adjacent surface of said bottom wall of said first pumping chamber.

9. The centrifuge of claim 2 wherein said deflector lip initially engages the surface of said bottom wall and thereafter is spaced therefrom upon rotation of said rotor bowl by abrasion of said bottom wall surface thereagainst.

10. The centrifuge of claim 9 wherein said spacing is approximately 0.10″.

* * * * *